United States Patent [19]

Hashizume

[11] Patent Number: 4,596,227

[45] Date of Patent: Jun. 24, 1986

[54] IGNITION APPARATUS FOR INTERNAL COMBUSTION ENGINES

[75] Inventor: Atsushi Hashizume, Himeji, Japan

[73] Assignee: Mitsubishi Denki Kabushiki Kaisha, Tokyo, Japan

[21] Appl. No.: 654,501

[22] Filed: Sep. 26, 1984

[30] Foreign Application Priority Data

Sep. 28, 1983 [JP] Japan ..... 58-181858

[51] Int. Cl.[4] ..... F02P 1/08

[52] U.S. Cl. ..... 123/643; 123/480

[58] Field of Search ..... 123/643, 610, 890, 640, 123/652, 612, 480

[56] References Cited

U.S. PATENT DOCUMENTS

| | | | |
|---|---|---|---|
| 4,170,207 | 10/1979 | Bayama | 123/643 |
| 4,250,858 | 2/1981 | Jeenicke et al. | 123/480 |
| 4,292,943 | 10/1981 | Kyogoku et al. | 123/643 |
| 4,351,307 | 9/1982 | Komurasaki et al. | 123/612 |
| 4,359,037 | 11/1982 | Stangl | 123/643 |
| 4,378,004 | 3/1983 | Petrie | 123/643 |
| 4,385,605 | 5/1983 | Petri et al. | 123/643 |
| 4,457,286 | 7/1984 | Katayama et al. | 123/643 |
| 4,462,380 | 7/1984 | Asik | 123/643 |

*Primary Examiner*—Raymond A. Nelli

*Attorney, Agent, or Firm*—Leydig, Voit & Mayer, Ltd.

[57] ABSTRACT

An ignition apparatus for an internal combustion engine having two or more cylinders. Two or more sensors are correspondingly associated with the two or more cylinders. These sensors are further correspondingly associated with flip-flops. The outputs of these flip-flops are combined by an OR gate and then distributed by an additional distributing flip-flop and AND gates for each of ignition elements also associated with the cylinders, whereby even though the output of any one of the sensors fails to attain a required level of the flip-flops, an erroneous distribution is prevented for the ignition elements of the engine.

9 Claims, 6 Drawing Figures

IGNITION APPARATUS FOR INTERNAL COMBUSTION ENGINES

BACKGROUND OF THE INVENTION

The present invention relates to an ignition apparatus for internal combustion engines, and particularly to an ignition apparatus for multi-cylinder internal combustion engines not using a high voltage distributor.

A contactless ignition apparatus of this type has already been proposed in, for example, Japanese Patent Laid-Open No. 50263/1981. This apparatus has first and second sensors provided to correspond to the number of cylinders (for instance, two cylinders) of an internal combustion engine, and has first and second ignition coils that generate a secondary voltage to produce sparks for the internal combustion engine. The sensors are crank angle sensors that detect the igniting positions relying upon the turning of the rotor rotated by the engine. An igniting position control circuit and a conduction control circuit are operated by the signals from these sensors, the igniting positions and the conduction initiating positions are determined by an arithmetic circuit relying upon the outputs of these circuits, and the individual switching elements are controlled by the outputs of the arithmetic circuit thereby to control an electric current that flows into the ignition coils. Furthermore, provision is made of AND circuits in a number corresponding to the number of ignition coils, as well as n/2 flip-flop circuits when the number of AND circuits n is an even number, or $(n+1)/2$ flip-flop circuits when the number of AND circuits n is an odd number.

Operation of this apparatus will be explained below with reference to FIG. 1, which is a wave-form diagram.

Detection signals A of the first sensor and detection signals B of the second sensor are combined, and flip-flop circuits are operated to obtain rectangular output signals C. Signals obtained from the igniting position control circuit and the conduction control circuit, with the signals C as a reference, are modified by the arithmetic circuit to obtain signals D that include signals for the first and second cylinders. Then, depending upon the output condition of a distributing flip-flop, the signals are distributed. For example, when the signal E of the distributing flip-flop has a level of "1" (high level), the signal D, having a high level, is distributed as a signal F for the first cylinder through a logic gate. When the signal E has a level of "0" (low level), the signal D, having a low level, is distributed as a signal G for the second cylinder via a logic gate. The thus distributed signals energize the first and second switching elements, whereby a primary current represented by a signal H flows into the first ignition coil, and a primary current represented by a signal I flows into the second ignition coil. Therefore, an ignition spark J generates in the first cylinder at the time of ignition for the first cylinder, and an ignition spark K also generates in the second cylinder. Namely, depending upon the output condition of the distributing flip-flop, i.e., depending upon the signals E, the signals D that have been combined for the first and second cylinders are distributed as signals F and signals G for each of the cylinders. Therefore, when the output conditions of the distributing flip-flop or the signals E do not properly correspond to the crank angle position of the engine, the ignition signal to be distributed to the first cylinder is erroneously distributed to the second cylinder, or conversely, the ignition signal to be distributed to the second cylinder is erroneously distributed to the first cylinder, resulting in erroneous ignition.

FIGS. 2 and 3 are diagrams of wave forms in the cases of cranking operation. The ignition will be described below more concretely with reference to these drawings.

Crest values in the outputs of the first and second sensors of the type of tachometer generator change as shown, for example, by signals A and B, accompanying the change in the speed of revolution of the engine that results from the change in torque of the engine or the like. That is, if the instantaneous speed at a given moment is slow, the crest value produced by the sensor becomes low. During the time of cranking, there is generally no need of advancing the ignition timing, and the conduction control circuit does not need to be operated, either. Therefore, the moment at which the primary current starts to flow into the ignition coil has been set to a first or a third crank angle position L1 or L2 (hereinafter referred to as position L1 or position L2) which the sensor will detect, and the moment at which the primary current is interrupted (i.e., the ignition time) has been set to a second or a fourth crank angle position T1 or T2 (hereinafter referred to as position T1 or position T2) which the sensor will detect. In the case of FIG. 2, crest values produced by the sensors exceed the threshold voltage (the voltage at which the flip-flop is activated, indicated by the upper and lower lines) of the flip-flop, and the apparatus as a whole properly operates.

Referring to FIG. 3, however, the signal level at the position T2 detected by the second sensor does not reach the threshold voltage (lower dashed line of FIG. 3B) of the flip-flop during a time period t. This is because the vicinity of position T2 corresponds to the latter half of the compression stroke of the engine where the engine turns most slowly. Therefore, the instantaneous speed of the engine is slow, and the crest value produced by the sensor is low. Upon receipt of the sensor output at the position T2, the flip-flop should have been inverted as represented by the signals C in FIGS. 1 and 2. However, since the crest value is low as described above, the flip-flop is not inverted. Therefore, the level "1" of signal of FIG. 3C at the position L2 and the level "0" of signal of FIG. 3E at the position L2, remain unchanged. The sensor output at the subsequent position L1 is greater than the threshold voltage of the flip-flop, and hence, a set input is sent to the flip-flop which produces the signal C. However, since the flip-flop which produces the signal C has already been set (i.e., C="1"), the set input is processed as an invalid signal, and the signal C maintains a level of "1". This state continues until the flip-flop, which produces the signal C responsive to the sensor output at the subsequent position T1, is reset so that the signal C assumes a level of "0".

Furthermore, the flip-flop which produces the signal E responsive to the sensor output at the position T1 receives a reset input. However, for the same reasons as described above, the signal E maintains a level of "0" until the flip-flop which produces the signal E at the next position T2 is set and inverted to a level of "1".

FIG. 3D has the same wave forms as FIG. 3C. This is because there is no need of controlling the conduction ratio or the ignition timing during the period of cranking, and the wave forms of FIG. 3D become analogous to the wave forms of FIG. 3C.

The signal F assumes the level "1" when the signal D has the level "1" and the signal E has the level "1". The signal G assumes the level "1" when the signal D assumes the level "1" and the signal E assumes the level "0". Namely, if expressed by Boolean equations, $F=D\cdot E$, and $G=D\cdot\bar{E}$. Therefore, the signal wave forms become as shown in FIGS. 3F and 3G after the signal D has been distributed by the distributing flip-flop which produces the signal E. Interruption of the primary current from flowing into the first and second coils occurs each time that the signals F and G, respectively, go from a high to a low level. Therefore, the wave form of the primary current of the ignition coil for the first cylinder is as shown in FIG. 3H, and the ignition spark in the first cylinder is as shown in FIG. 3J.

However, the wave form of the primary current of the ignition coil for the second cylinder is as shown in FIG. 3I, and the ignition spark in the second cylinder is as shown in FIG. 3K. It will be understood that although the position T1 corresponds to the ignition time for the first cylinder, the ignition spark is erroneously generated in the second cylinder as indicated by the circular dashed line.

In the conventional ignition apparatus, when the sensor output at the position T2 in time period t fails to reach the threshold voltage of the flip-flop, the ignition spark that should be generated in the first cylinder at the position T1 is generated in the second cylinder, and erroneous ignition resulting from erroneous distribution adversely affects the engine. Concretely speaking, great deviation in the ignition timing gives rise to the occurrence of serious accidents such as damage to the engine.

U.S. Pat. No. 3,757,755 (issued to W. J. Carner on Sept. 11, 1973) discloses an engine control apparatus according to which the ignition timing of each cylinder is calculated by a variable delay circuit using ignition timing signals for a plurality of cylinders, and the calculated results are distributed at a low voltage by a firing logic circuit for each of the cylinders.

SUMMARY OF THE INVENTION

The object of the present invention is to eliminate the defects inherent in the prior art and to provide an ignition apparatus for internal combustion engines, wherein a flip-flop which is operated by a signal detected by the first sensor and a flip-flop which is operated by a signal detected by the second sensor, are provided separately from each other, and output signals of these flip-flop circuits are combined, so that the electric current will not be erroneously distributed even when the sensor outputs do not reach the operation levels of the flip-flop circuits.

More specifically, the present invention provides, an ignition apparatus for an internal combustion engine comprising: at least two sensors driven by the engine, the first one providing first and second detection outputs respectively at first and second crank angle positions of the engine, and the second one providing third and fourth detection outputs respectively at third and fourth crank angle positions of the engine; a first bistable means operable by the first and second detection outputs of the first sensor; a second bistable means operable by the third and fourth detection outputs of the second sensor; a third bistable means operable by the first and third detection outputs or by the second and fourth detection outputs; means for combining the output signals of the first and second bistable means; and, means for distributing the combined signal into ignition signals corresponding to a predetermined number of cylinders.

BRIEF DESCRIPTION OF THE DRAWINGS

In the drawings, the same reference numerals denote the same or corresponding portions.

DETAILED DESCRIPTION OF THE PREFERRED EMBODIMENT

An embodiment of the present invention will be described below with reference to the drawings.

Figure 1:
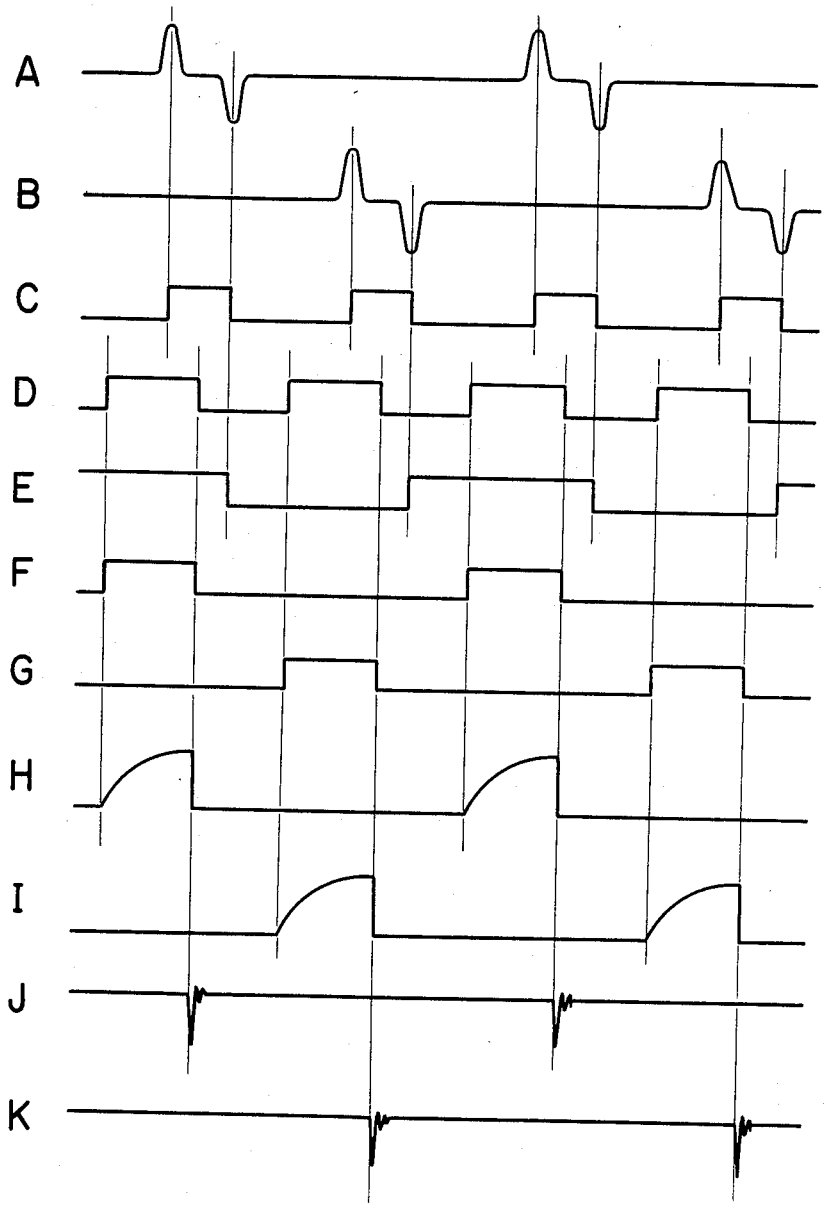
FIG. 1 (PRIOR ART)
FIGS. 1 to 3 are diagrams of wave forms for explaining the operation of a conventional ignition apparatus for internal combustion engines.
Figure 2:
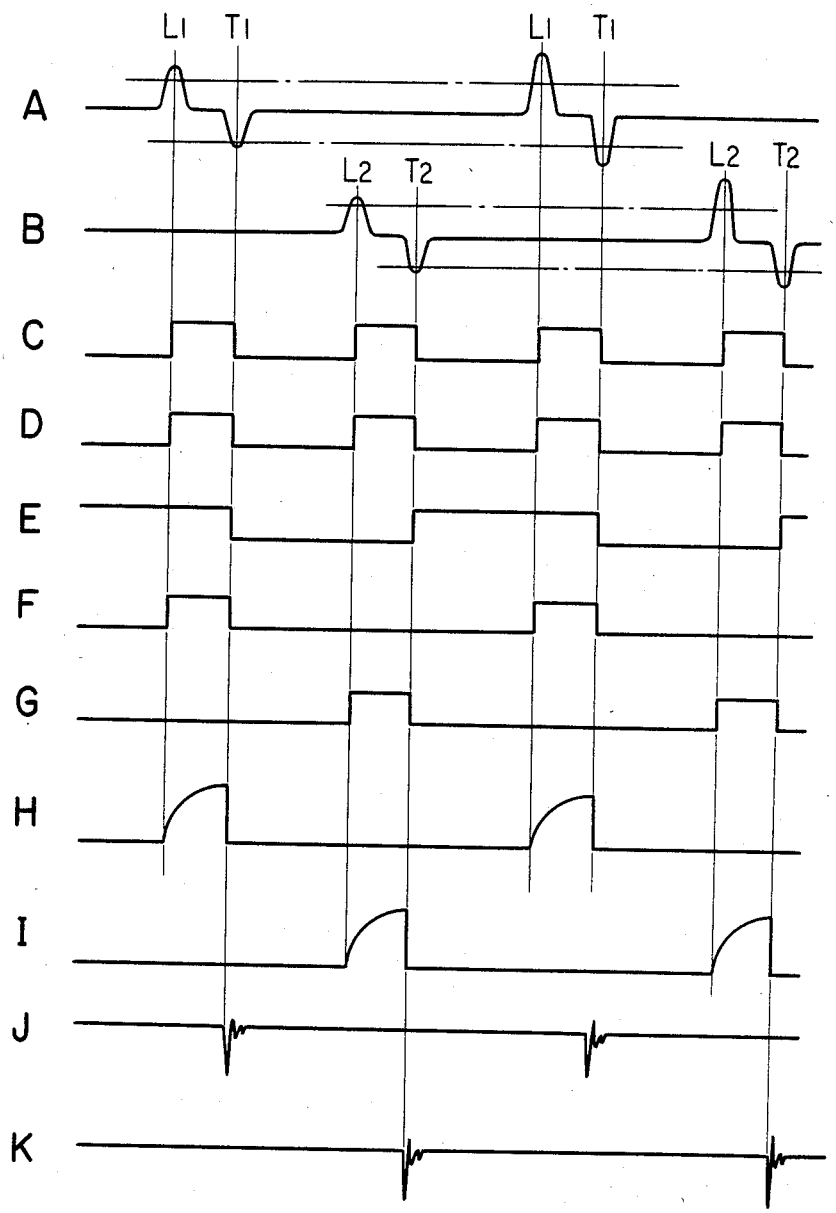
FIG. 2 (PRIOR ART)
Figure 3:
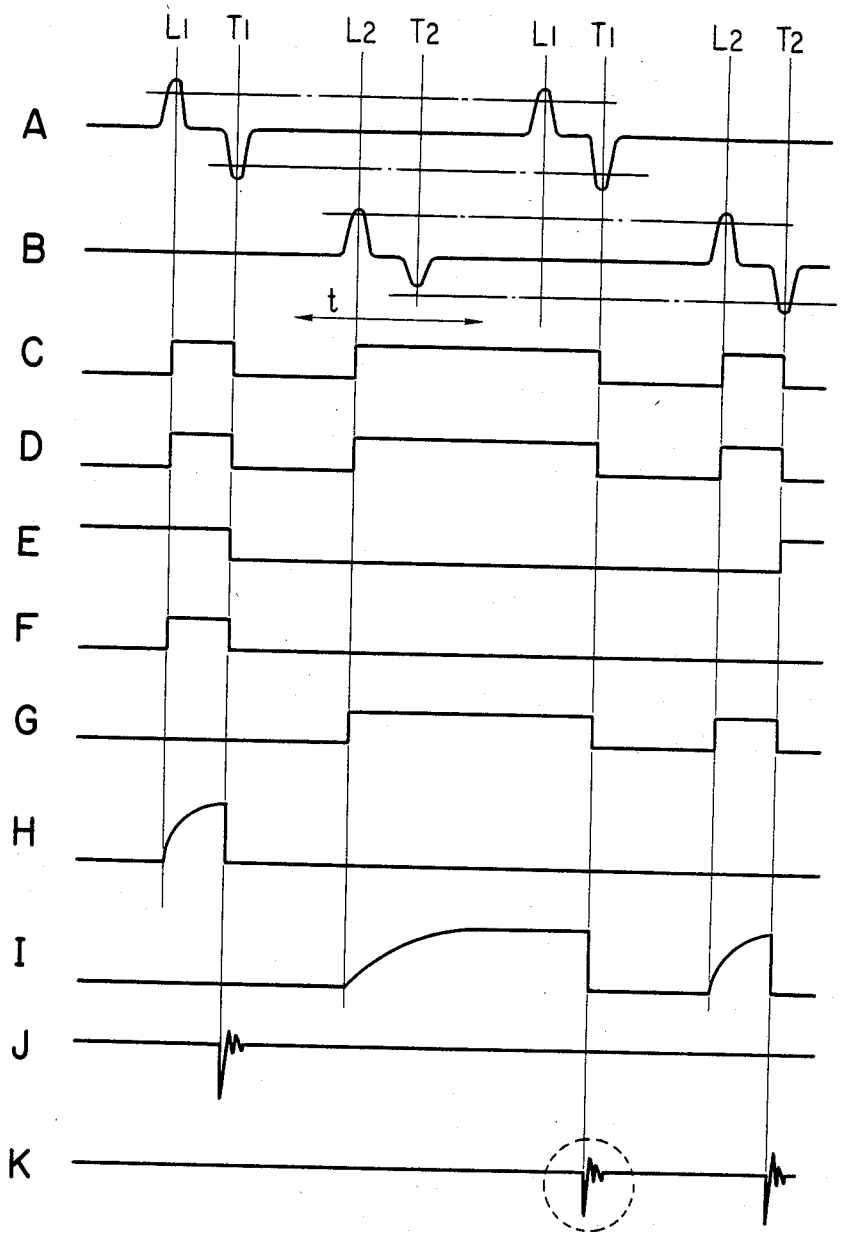
FIG. 3 (PRIOR ART)
Figure 4:
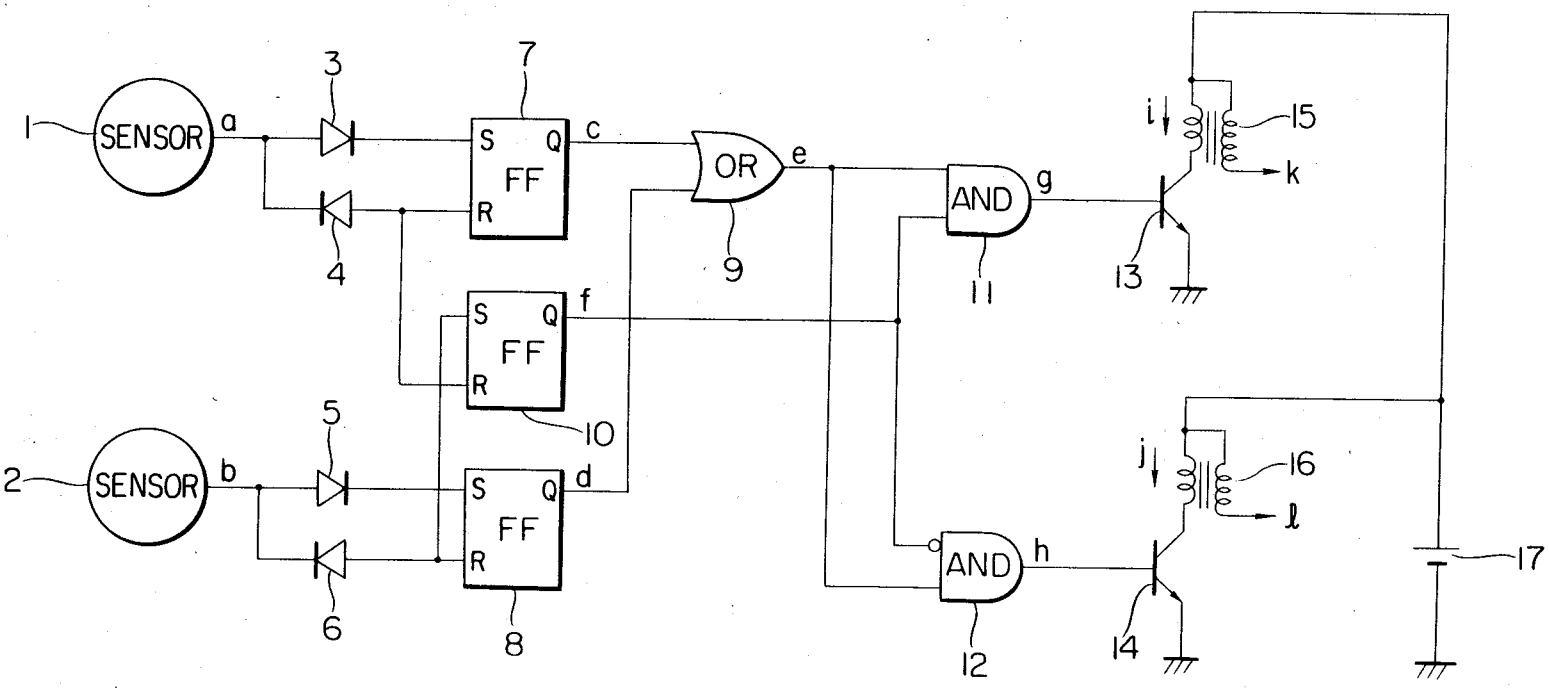
FIG. 4 is a circuit diagram of an ignition apparatus for internal combustion engines according to a preferred embodiment of the present invention.

FIG. 4 is a circuit diagram of an ignition apparatus for internal combustion engines according to a preferred embodiment of the present invention, wherein provision is made of a first sensor 1 for detecting the crank angle position of the first cylinder and a second sensor 2 for detecting the crank angle position of the second cylinder. First and second diodes 3 and 4 are connected to the first sensor 1 to discriminate positive waves and negative waves in the output wave forms of the first sensor 1. Third and fourth diodes 5 and 6 are connected to the second sensor 2 to discriminate positive waves and negative waves in the output wave forms of the second sensor 2. A first flip-flop 7 has a set terminal S connected to the cathode of the first diode 3 and a reset terminal R connected to the anode of the second diode 4. A second flip-flop 8 has a set terminal S connected to the cathode of the third diode 5, and a reset terminal R connected to the anode of the fourth diode 6. A first gate 9 consists of an OR circuit which combines an output signal c from the output terminal Q of the flip-flop 7 and an output signal d from the output terminal Q of the flip-flop 8.

A third flip-flop 10 has a set terminal S connected to the anode of the fourth diode 6, and a reset terminal R connected to the anode of the second diode 4.

A second gate 11 receives an output signal e from the first gate 9 and an output signal f from the flip-flop 10, and produces an output signal g having the value $g=e\cdot f$. Namely, the signal g assumes the level "1" only when both the signal e and the signal f have the level "1". A third gate 12 receives the output signal e of the first gate 9 and the output signal f of the flip-flop 10, and produces an output signal h having the value $h=e\cdot\bar{f}$. Namely, the signal h assumes the level "1" only when the signal e has the level "1" and the signal f has the level "0".

A first transistor 13 interrupts the primary current i from flowing into a first ignition coil 15 responsive to the output signal g of the second gate 11. A second transistor 14 interrupts the primary current j from flowing into a second ignition coil 16 responsive to the output signal h of the third gate 12. To the ignition coils 15 and 16 has been connected a storage battery 17 which is a power source therefor.

Figure 5:
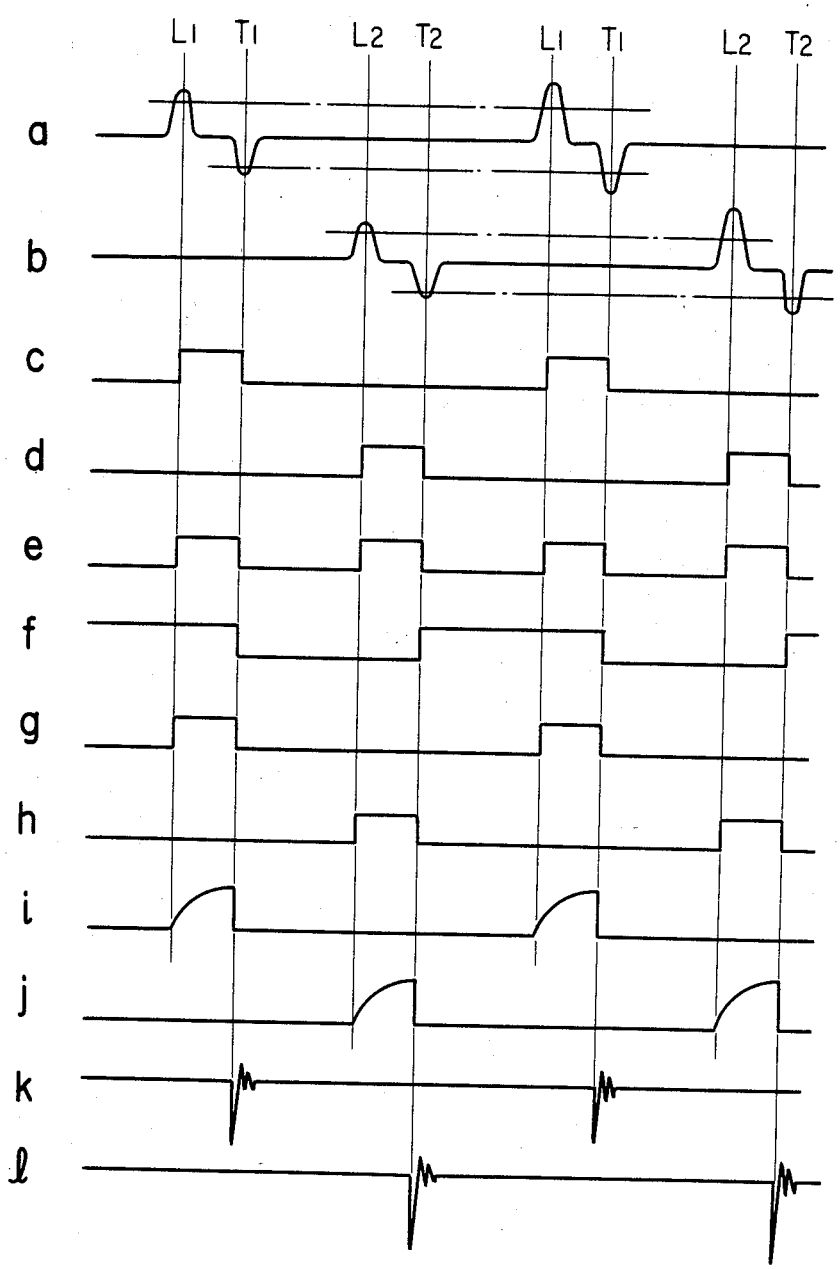
FIGS. 5 and 6 are diagrams of wave forms for explaining the operation of the embodiment of FIG. 4.
Figure 6:
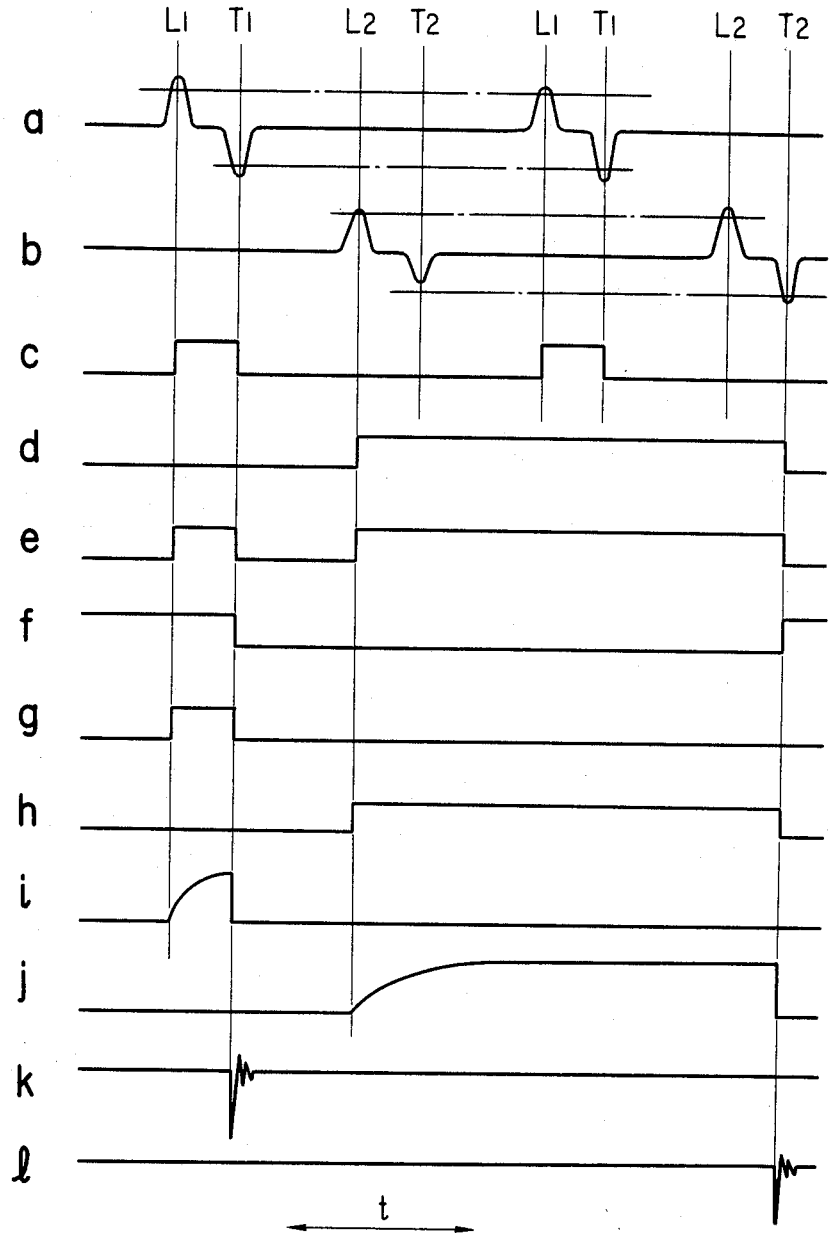

FIGS. 5 and 6 are diagrams of wave forms for explaining the operation of the embodiment of FIG. 4. Wave forms a to l are those of signals denoted by the same symbols in FIG. 4. Operation of the apparatus of FIG. 4 will be described below in conjunction with the wave forms of these diagrams.

FIG. 5 explains the cranking operation. It is presumed that the crest values produced by the first and second sensors 1, 2 are greater than the operation levels of the flip-flop circuits 7, 8 and 10. A positive wave of the output signal a of the first sensor 1 generated at the position L1 passes through the first diode 3, and sets the flip-flop 7. Therefore, the flip-flop 7 produces a signal c of the level "1". The signal c continues until a negative wave of the first sensor 1 generated at the position T1 passes through the second diode 4 to reset the flip-flop 7. The signal c alternatingly assumes the level "0" and the level "1" in response to the signal a produced by the first sensor 1.

A positive wave of the output signal b by the second sensor 2 generated at the position L2 for the second cylinder passes through the third diode 5 to set the flip-flop 8. Then, a negative wave generated at the subsequent position T2 passes through the fourth diode 6 to reset the flip-flop 8. Like the case of the above-mentioned flip-flop 7, the signal d produced by the flip-flop 8 alternatingly assumes the level "0" and "1" in response to the signal b produced by the second sensor 2. The above two output signals c and d are combined by the OR gate 9 as shown in FIG. 5*e* to cope with the two cylinders.

Thus, the diodes 3 and 4 serve to discriminate the output signal a of the sensor 1 to set and reset the flip-flop 7 respectively while the diodes 5 and 6 serve to discriminate the output signal b of the sensor 2 to set and reset the flip-flop 8 respectively.

The distributing flip-flop 10 is reset by the negative wave generated by the first sensor 1 at the position T1, and is set by the negative wave generated by the second sensor 2 at the position T2. Therefore, the signal f produced by the flip-flop 10 alternatingly assumes the level "1" and the level "0" in response to the outputs of the first sensor 1 and the second sensor 2. The period in which the signal f assumes the level "1" is related to the first cylinder, and the period in which the signal f assumes the level "0" is related to the second cylinder. Therefore, only during the period in which the signal f assumes the level "1", the signal e is provided as an output by the AND gate 11, and only during the period in which the signal f assumes the level "0", the signal e is provided as an output by the AND gate 12 (FIGS. 5*g* and 5*h*).

The primary current of the first ignition coil 15 starts to flow from the position L1 where the first transistor 13 is rendered conductive, and is interrupted at the position T1 where the first transistor 13 is rendered nonconductive and an ignition spark is produced at this moment (FIGS. 5*i* and 5*k*). Similarly, the primary current of the second ignition coil 16 starts to flow from the position L2 where the second transistor 14 is rendered conductive, and is interrupted at the position T2 where the second transistor 14 is rendered nonconductive and an ignition spark is produced at this moment (FIGS. 5*j* and 5*l*).

In the foregoing has been described the fundamental operation only. In a practical ignition apparatus, however, the conduction ratio and the ignition timing are controlled by relying upon the output signal e of the OR gate 9, and the result is distributed as a signal for the first cylinder and a signal for the second cylinder using AND gates 11 and 12. In response to the thus distributed signals, the transistors are rendered conductive or nonconductive, and the primary current flows into the ignition coils for predetermined periods of time to build up sufficient amounts of energy. Then, a secondary high voltage is generated at igniting positions required for the engine. In addition to the above-mentioned method, either the conduction ratio or the ignition period may be controlled.

Described below is the case when the crest value produced by the second sensor 2 at the position T2 does not reach the threshold voltage of the flip-flop in conjunction with FIG. 6.

The output signal c of the flip-flop 7 is shown in FIG. 6*c* which is the same as FIG. 5*c*. However, the output signal d of the flip-flop 8 receives the positive wave of the second sensor 2 at the position L2 in the time section t, and rises from the level "0" to the level "1". The flip-flop 8 is not reset by the negative wave at the position T2, and the output signal d maintains the level "1". The positive wave of the second sensor 2 at the position L2 of the next period is invalidated, and the signal d still maintains the level "1". The flip-flop 8 is then reset by the negative wave produced by the second sensor 2 at the position T2, and the output signal d returns to the level "0" as shown in FIG. 6.

The OR gate 9 performs an OR operation on the signal c produced by the flip-flop 7 and the signal d produced by the flip-flop 8. Therefore, the signal produced by the OR gate 9 maintains the level "1" from the position L2 of time period t to the position T2 of the next period (FIG. 6*e*). Like the above-mentioned case, the signal f produced by the distributing flip-flop 10 is inverted from the level "1" to the level "0" at the first position T1, and then maintains the level "0" until it is inverted again to the level "1" when the crank angle position is T2 for the second time (FIG. 6*f*). Therefore, the signal g produced by the AND gate 11 maintains the level "1" from the position L1 to the first occurrence of position T1 (FIG. 6*g*), and the signal h produced by the AND gate 12 maintains the level "1" from the position L2 in the time period t to the position T2 of the next period (FIG. 6*h*).

The primary current and the secondary voltage of the first ignition coil 15 are as shown in FIGS. 6*i* and 6*k*, and the primary current and the secondary voltage of the second ignition coil 16 are as shown in FIGS. 6*j* and 6*l*. Thus, it will be recognized that no ignition spark is generated at the second occurrence of position T1 for the first cylinder or the second cylinder, and there takes place no erroneous ignition resulting from erroneous distribution of current. It will be obvious to those skilled in the art that the present invention is in no way limited to the above-mentioned embodiment but can be modified in a variety of ways. For instance, although the above-mentioned embodiment has dealt with the case where the invention has been adapted to a two-cylinder engine having first and second cylinders, the invention can also be adapted to engines having three or more cylinders by increasing the number of sensors and the numbers of diodes, flip-flop circuits and gates for sorting the positive and negative signals of the sensors, to obtain the same effects as those of the above-mentioned embodiment.

Furthermore, the gates need not be limited to those of the above-mentioned embodiment. Instead, NAND gates may be employed depending upon negative logics.

The foregoing description further has described the ignition coils into which the primary current was permitted to flow so that the energy accumulated in the primary windings of the coils was turned into ignition sparks. The ignition coils, however, need not necessarily be limited thereto.

In the above embodiment, furthermore, the signal f produced by the flip-flop 10 was associated with the first cylinder when it possessed the level "1". Conversely, the signal f may be associated with the first cylinder when it possesses the level "0".

In the above description, moreover, the flip-flop 10 was set and reset by the negative wave (position T1) of the first sensor 1 and by the negative wave (position T2) of the second sensor 2. The gist of the invention, however, is the same even when the flip-flop 10 is set and reset by using the positive wave (position L1) of the first sensor 1 and by using the positive wave (position L2) of the second sensor 2.

According to the present invention as described in the foregoing, provision is made of a flip-flop which is operated by a signal detected by the first sensor and a flip-flop which is operated by a signal detected by the second sensor, separately from each other, and signals produced by these flip-flops are combined. It is therefore possible to obtain an ignition apparatus for internal combustion engines that does not erroneously distribute the electric current even when the outputs of the sensors do not reach the operation levels of the flip-flops.

What is claimed is:

1. An ignition apparatus for an internal combustion engine comprising:

at least two sensors driven by said engine, the first one providing first and second detection outputs, respectively, at first and second crank angle positions of said engine, and the second one providing third and fourth detection outputs, respectively, at third and fourth crank angle positions of said engine;

a first bistable means operable by said first and second detection outputs of a predetermined level from said first sensor;

a second bistable means operable by said third and fourth detection outputs of a predetermined level from said second sensor;

a third bistable means operable by one of said first and second detection outputs of a predetermined level and one of said third and fourth detection outputs of a predetermined level to produce a control output;

means for combining the output signals of said first and second bistable means and providing logical combined signals representing ignition signals only when a sensor output exceeds a predetermined level to avoid erroneous ignition signals;

means receiving the logical combined signals and the control output of said third bistable means; and means for distributing said logical combined signals into ignition signals corresponding to a predetermined number of cylinders.

2. An ignition apparatus for an internal combustion engine according to claim 1 wherein said first bistable means comprises a first flip-flop, and first and second diodes, said first and second diodes serving to discriminate the output of said first sensor to respectively set and reset said first flip-flop.

3. An ingnition apparatus for an internal combustion engine comprising:

at least two sensors driven by said engine, the first one providing first and second detection outputs, respectively, at first and second crank angle positions of said engine, and the second one providing third and fourth detection outputs, respectively, at third and fourth crank angle positions of said engine;

a first bistable means operable by said first and second detection outputs of a predetermined level from said first sensor;

a second bistable means operable by said third and fourth detection outputs of a predetermined level from said second sensor, said second bistable means comprising a second flip-flop, and third and fourth diodes, said third and fourth diodes serving to discriminate the output of said second sensor to respectively set and reset said second flip-flop;

a third bistable means operable by one of said first and second detection outputs of a predetermined level and one of said third and fourth detection outputs of a predetermined level to produce a control output;

means for combining the output signals of said first and second bistable means and providing logical combined signals representing ignition signals only when a sensor output exceeds said predetermined level to avoid erroneous ignition signals;

means receiving the logical combined signals and the control output of said third bistable means; and means for distributing said logical combined signals into ignition signals corresponding to a predetermined number of cylinders.

4. An ignition apparatus for an internal combustion engine comprising:

at least two sensors driven by said engine, the first one providing first and second detection outputs, respectively, at first and second crank angle positions of said engine, and the second one providing third and fourth detection outputs, respectively, at third and fourth crank angle positions of said engine;

a first bistable means operable by said first and second detection outputs of a predetermined level from said first sensor comprising a first flip-flop and first and second diodes, said first and second diodes serving to discriminate the output of said first sensor to respectively set and reset said first flip-flop;

a second bistable means operable by said third and fourth detection outputs of a predetermined level from said second sensor;

a third bistable means operable by one of said first and second detection outputs of a predetermined level and one of said third and fourth detection outputs of a predetermined level to produce a control output;

means for combining the output signals of said first and second bistable means and providing logical combined signals representing ignition signals only when a sensor output exceeds a predetermined level to avoid erroneous ignition signals;

means receiving the logical combined signals and the control output of said third bistable means; and means for distributing said logical combined signals into ignition signals corresponding to a predetermined number of cylinders;

the anode of said first diode being connected to said first sensor and the cathode thereof being connected to the set input terminal of said flip-flop, the cathode of said second diode being connected to said first sensor and the anode thereof being connected to the reset input terminal of said first flip-flop.

5. An ignition apparatus for an internal combustion engine according to claim 3 wherein the anode of said third diode is connected to said second sensor and the cathode thereof is connected to the set input terminal of said second flip-flop, and the cathode of said fourth diode is connected to said second sensor and the anode thereof is connected to the reset input terminal of said second flip-flop.

6. An ignition apparatus for an internal combustion engine according to claim 5 wherein said third bistable means comprises a third flip-flop whose set input terminal is connected to the reset input terminal of said second flip-flop and whose reset input terminal is connected to the reset input terminal of said first flip-flop.

7. An ignition apparatus for an internal combustion engine according to claim 6 wherein said serially composing means comprises an OR gate having two input terminals connected to the output terminals of said first and second flip-flops, respectively.

8. An ignition apparatus for an internal combustion engine according to claim 7 wherein said distributing means comprises first and second AND gates, and first and second electronic switching means connected to said first and second AND gates respectively, one input terminal of said first AND gate being connected to the output terminal of said OR gate and one input terminal of said second AND gate, the other input terminal of said first AND gate being connected to the output terminal of said third flip-flop and the other inverting input terminal of said second AND gate.

9. An ignition apparatus for an internal combustion engine according to claim 8 wherein said first and second switching means comprises first and second transistors respectively driven by said first and second AND gates, and first and second ignition coils respectively energized or deenergized by said first and second transistors.

* * * * *